US005913620A

United States Patent [19]

Joseloff

[11] Patent Number: 5,913,620

[45] Date of Patent: Jun. 22, 1999

[54] DEVICE FOR HANGING OBJECTS OR PICTURES

[76] Inventor: Michael Joseloff, 1148 Fifth Ave., Apt. 9D, New York, N.Y. 10128

[21] Appl. No.: 08/819,260

[22] Filed: Mar. 18, 1997

[51] Int. Cl.[6] ..... G09F 7/00

[52] U.S. Cl. ..... 40/757; 40/657; 40/622; 248/475.1

[58] Field of Search ..... 40/757, 761, 745, 40/657, 620, 622; 248/475.1, 493; 211/106, 103

[56] References Cited

U.S. PATENT DOCUMENTS

| | | | |
|---|---|---|---|
| 896,753 | 8/1908 | Peterson | 40/747 |
| 3,865,342 | 2/1975 | Kanzelberger | 40/757 X |
| 5,335,433 | 8/1994 | Borden | 40/737 |
| 5,444,929 | 8/1995 | Joseloff . | |

*Primary Examiner*—Cassandra H. Davis
*Attorney, Agent, or Firm*—Arthur L. Plevy

[57] ABSTRACT

An attachment device for securing a frame to a display apparatus of a type having a support grid, the support grid comprising a first plurality of parallel members and a second plurality of parallel members, wherein the first and second plurality of parallel members intersect at a predetermined angle and have a uniform thickness to define a plurality of compartments. The attachment device includes: a planar base having top and bottom oppositely-disposed surfaces; a support panel secured to one surface of the planar base, the support panel being adapted to be inserted within a picture frame; and, a plurality of elongated legs disposed on the other surface of the planar base. The legs are disposed generally perpendicular to the base and extend away from the base in the direction opposite the support panel, and are adapted to be inserted within the compartments of a grid structure for hanging the picture frame.

10 Claims, 4 Drawing Sheets

DEVICE FOR HANGING OBJECTS OR PICTURES

FIELD OF THE INVENTION

The present invention relates to a device for hanging an object or picture to a grid structure, and in particular, to the grid structure that is the subject of U.S. Pat. No. 5,444,929, entitled APPARATUS FOR THE DISPLAY OF A MULTIPLICITY OF OBJECTS OR PICTURES.

BACKGROUND OF THE INVENTION

For background regarding the invention, reference is made to U.S. Pat. No. 5,444,929, entitled APPARATUS FOR THE DISPLAY OF A MULTIPLICITY OF OBJECTS OR PICTURES, issued on Aug. 29, 1995, to Michael Joseloff, who also is the inventor herein (hereinafter the "Joseloff '929 patent"). The Joseloff '929 patent is hereby incorporated by reference.

The objective of the present invention is to provide a simple and effective means of securing a frame or other object to the display apparatus which is the subject of the Joseloff '929 patent. Further objects, features, and advantages of the present invention may become more apparent to those skilled in the art as the nature of the invention is better understood from the accompanying drawings and detailed description.

SUMMARY OF THE INVENTION

Summarily described, the present invention embraces a device for securing a frame or other object to a display apparatus of the type disclosed in the Joseloff '929 patent. The device comprises a planar base having two elongated and opposing surfaces and at least one side edge. A support panel is secured along one surface of the base for engaging the device in a picture frame, and a plurality of arms extend outwardly from the other surface, generally perpendicular to the base, for hanging the device on the display apparatus.

In a preferred embodiment, the plurality of arms are L-shaped, having a connecting member disposed perpendicular to the base and a hook member disposed generally parallel to the base. Preferably, the hook members face downwardly toward the bottom of the base so that when the arms of the device are inserted in the compartments of the display apparatus, the hook members rest against slats in the display apparatus and thereby support the device. Preferably, a side edge of the planar base has a notch or lip for accommodating the edge of a picture frame and enabling the device to be used to hang pictures either vertically or horizontally. Also, a pair of latches are pivotally attached to the support panel for helping to secure the device to the back of a picture frame.

BRIEF DESCRIPTION OF THE DRAWINGS

There is shown in the accompanying drawings an illustration of the invention as presently preferred, with it being understood that this invention is not limited to the precise apparatus shown. To illustrate the invention, a preferred embodiment is described below, considered together with the accompanying drawings, in which.

DETAILED DESCRIPTION OF THE INVENTION

Figure 1:
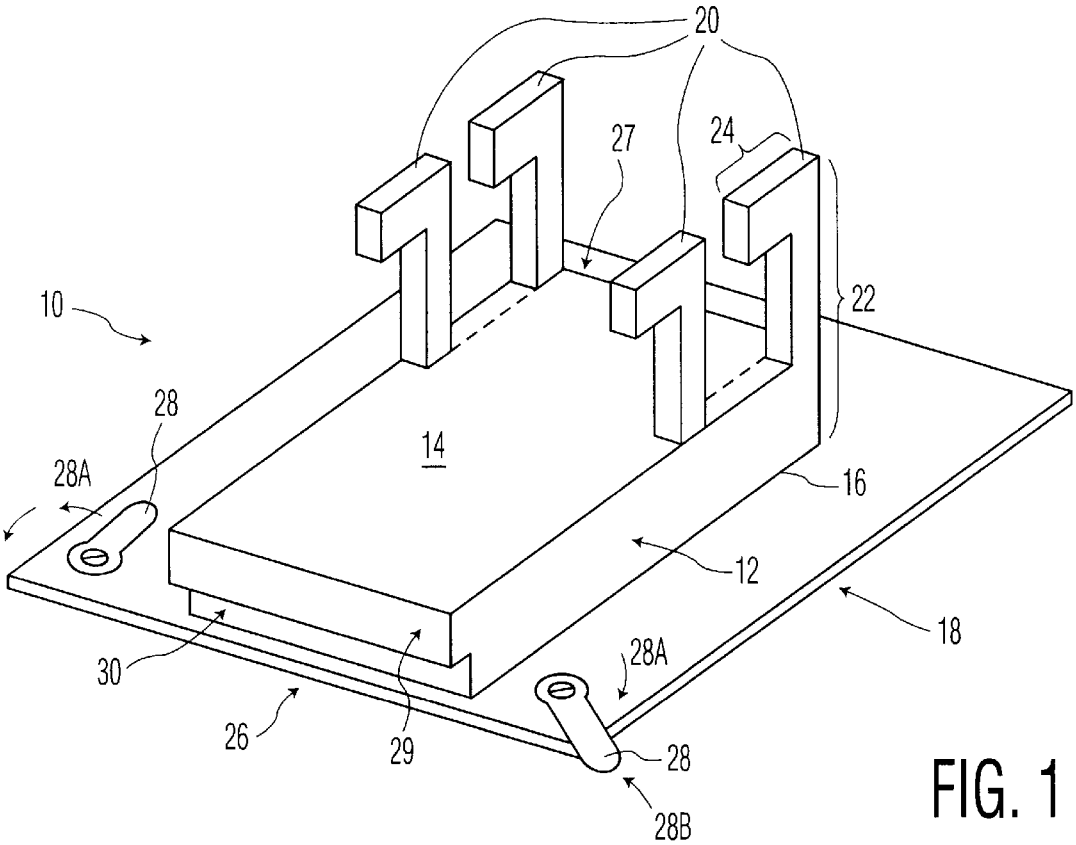
FIG. 1 shows a three-dimentional view of a preferred embodiment of the present invention, which is depicted separately from the frame and display apparatus for which the invention is adapted to be used.

Referring to FIG. 1, there is shown a preferred embodiment of the attachment device 10 of the present invention. Although the present invention can be used in many different applications where a planar object such as a diploma, poster, painting, or the like is to be displayed, the present invention is particularly well suited for use with a picture frame used for displaying a photograph. Accordingly, the invention will be described in connection with the display of a picture frame.

Referring to FIG. 1, the device 10 comprises a planar base 12 with a top surface 14 and an oppositely disposed bottom surface 16. A support panel 18 is secured along the bottom surface 16 of the base 12. The support panel 18 can be glued to the base 12, secured to the base with the use of screws, or attached to the base in any other manner; however, the means of attachment should be sufficiently secure so that the base does not rotate on the support panel, or vice versa.

The planar base 12 also has a plurality of legs 20 that extend outwardly from the base (that is, away from the top surface 14 and opposite the support panel). Preferably, the legs are L-shaped, having two members—a connecting member 22 and a hook member 24, with the connecting members 22 disposed substantially perpendicular to the base and the hook members 24 disposed substantially parallel to the base.

The planar base 12 also has two ends 26 and 27. One end 27 is disposed away from the edge of the support panel 18, while the other end 26 is disposed adjacent the opposite edge of the support panel 18. The end or side edge 26 adjacent the edge of the support panel 18 contains a notch or lip 29 which extends beyond the panel edge. The extension of the lip 29 beyond the support panel 18 can be more clearly seen in FIGS. 2 and 3. The lip 29 has two related functions. It makes the planar base longer at its upper surface 14 (as compared with the bottom surface 16), so that when the base is hooked onto the display apparatus, the bottom of the base will rest against a slat or grid of the display apparatus, thus maintaining the device in an upright position. At the same time, the lip makes the length of the base at its bottom surface 16 shorter (relative to the top surface) so that the edge of a picture frame can be inserted in the crevice 30 defined by the lip (as further shown in FIG. 5A).

Looking still at FIG. 1, diposed on the support panel 18 are two latches 28. The latches 28 are pivottally attached to the backing so that they can be rotated along the plane of the support panel 18, following, for example, the arrows 28A. When the latches are swung outward toward the corner of the device following arrows 28A, they protrude beyond the face of the support panel, such as at 28B (also seen in FIG. 2), for helping to secure the device to a picture frame.

Figure 2:
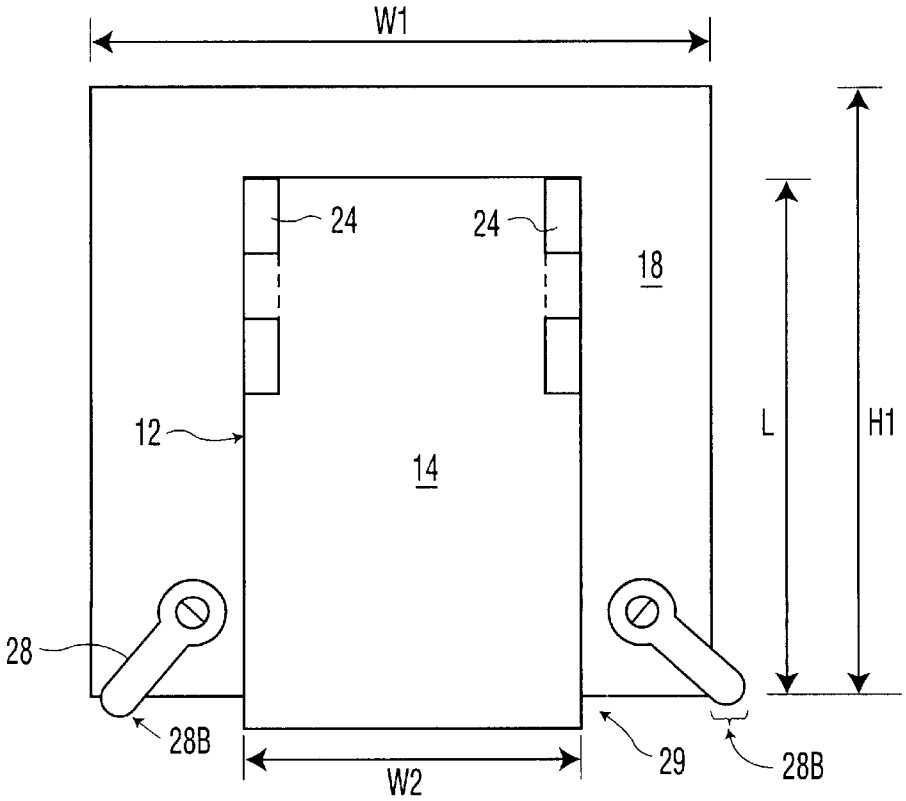
FIG. 2 shows a back view of a preferred embodiment of the present invention.

Referring now to FIG. 2, there is shown a back view of the attachment device 10. With this view, one can see the top surface 14 of the base secured to the support panel 18. The hook members 24 of the plurality of legs can be seen, as well as the latches 28 for securing the device to a frame.

The dimensions of the device naturally will depend upon the size and dimensions of the display apparatus and the size of the picture frame to be hung. However, a standard-sized picture frame is designed for hanging a four-by-six inch photograph. When such a frame is used, the support panel preferably is substantially square, having a height H1 of about four inches and a width W1 of about four inches. This way, the support panel can be rotated ninety degrees in the back of the frame so that the frame can be hung in either the vertical or horizontal position. Also, when used for a frame for hanging a 4×6 photo, the planar base 12 preferably has a length L of about three and one-half inches and a width W2 of about two and one-quarter inches. When a differently-sized frame is used, the dimensions of the support panel and the base should be adjusted proportionately.

Figure 3:
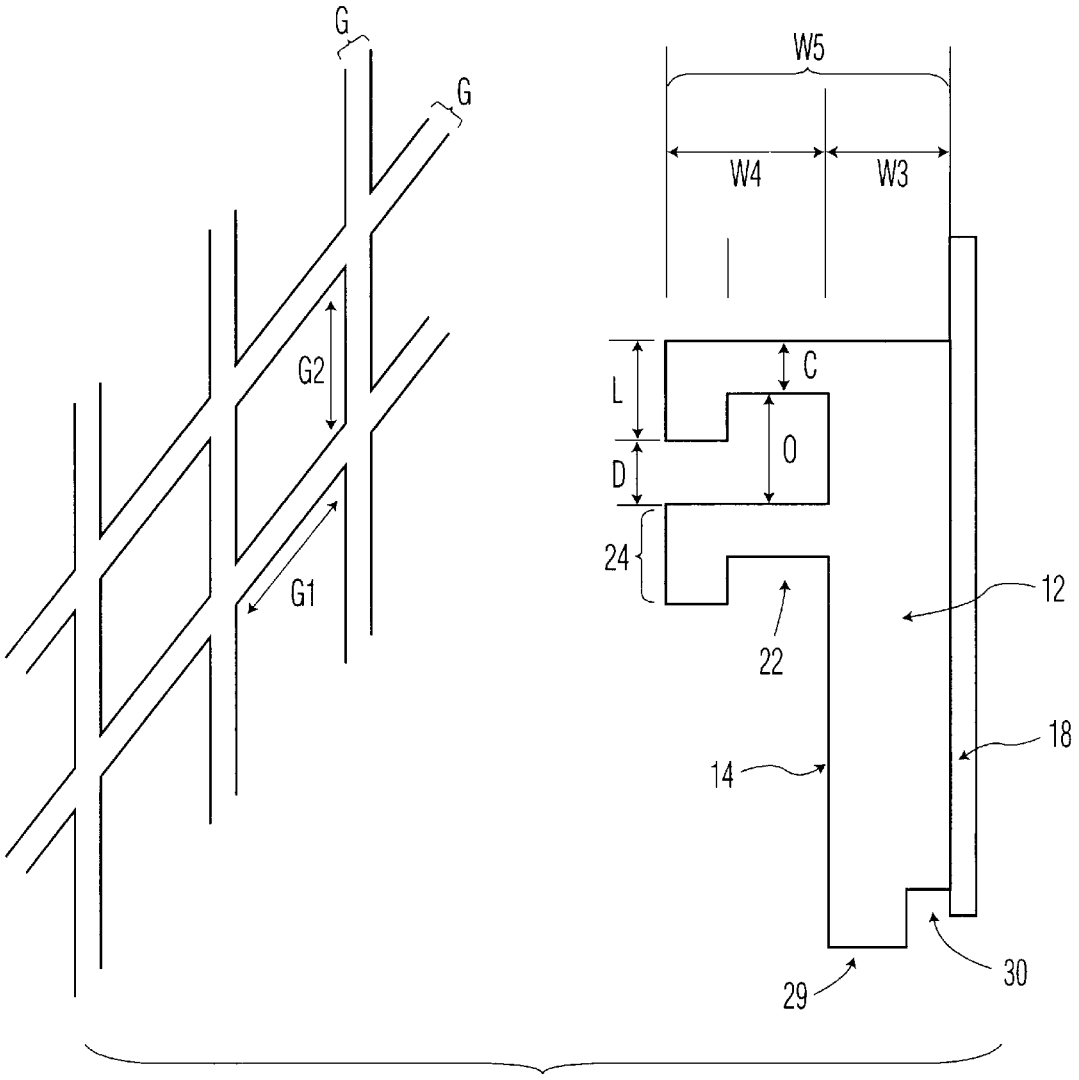
FIG. 3 shows a side view of a preferred embodiment of the present invention together with a portion of the display apparatus for which the device is adapted to be used.

Referring now to FIG. 3, there is shown a side view of the attachment device. Here, one can see the planar base 12, the support panel 18, and the connecting members 22 and hook members 24 that define the plurality of L-shaped legs 20. The size of the legs 20 will depend upon the size of the display apparatus or grid structure being used. For example, as shown in FIG. 3, a grid structure may have a plurality members each with a width G of 7/16 of an inch that intersect to define compartments having a width G1 of five and thirteen/sixteenths (5 and 13/16) of an inch and a height G2 of one and eleven/sixteenths (one and 11/16) of an inch. In that case, the width of the base W3 is preferably about three-quarters of an inch, and the width W4 defining the extension of the connecting members 22 is preferably about one inch. This results in a total width W5 for the planar base of about one and three-quarters inches. The preferred distance L for the length of the hook member is about one-half to five-eighths of an inch, and the preferred distance D for the gap between the legs at the most narrow point is about one-half of an inch. The distance C reflecting the width of the connecting member 22 is preferably about one quarter to three eights of an inch. Therefore, the open space O, defining the widest spacing between the legs, preferably is about five-eighths to three-quarters of an inch.

Figure 4:
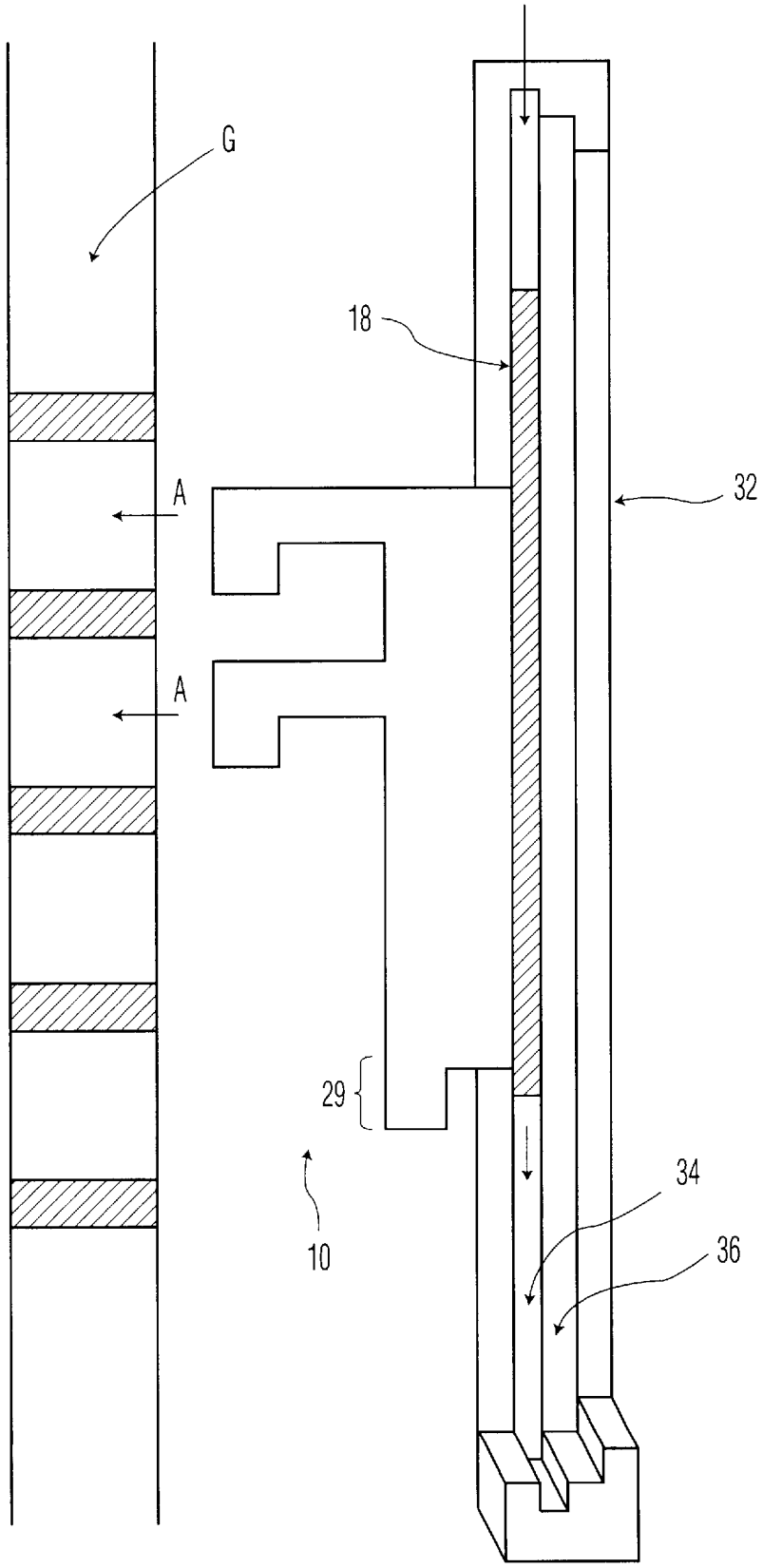
FIG. 4 shows a side view of a preferred embodiment of the present invention (not to scale), depicted together with a portion of a picture frame and display apparatus for which the invention is adapted to be used.

Referring now to FIG. 4, there is shown the attachment device 10 conjunction with the display apparatus or grid structure G and a portion of the frame 32 adapted to be used with the device. The frame 32 has two channels 34 and 36, with one channel 34 being deeper than the other channel 36. As shown in FIG. 4, the support panel 18 of the device 10 slides into the deeper channel 34, and the narrower channel 36 is designed to contain a piece of glass, a photograph, and a cardboard insert (not shown), which are well known and typically used in picture frames. Once the glass, photograph or picture, cardboard insert and attachment device are secured within the frame, the device and frame are hooked onto the grid structure by inserting the L-shaped arms of the device into the compartments of the grid structure, following the arrows A in FIG. 4. Further, the lip 29 at the bottom end of the device ensures that the device will rest against a slat of the grid structure and be maintained in an upright position so that the picture hangs vertically on the wall, as opposed to slanting away from the wall near the top of the frame.

Figure 5A:
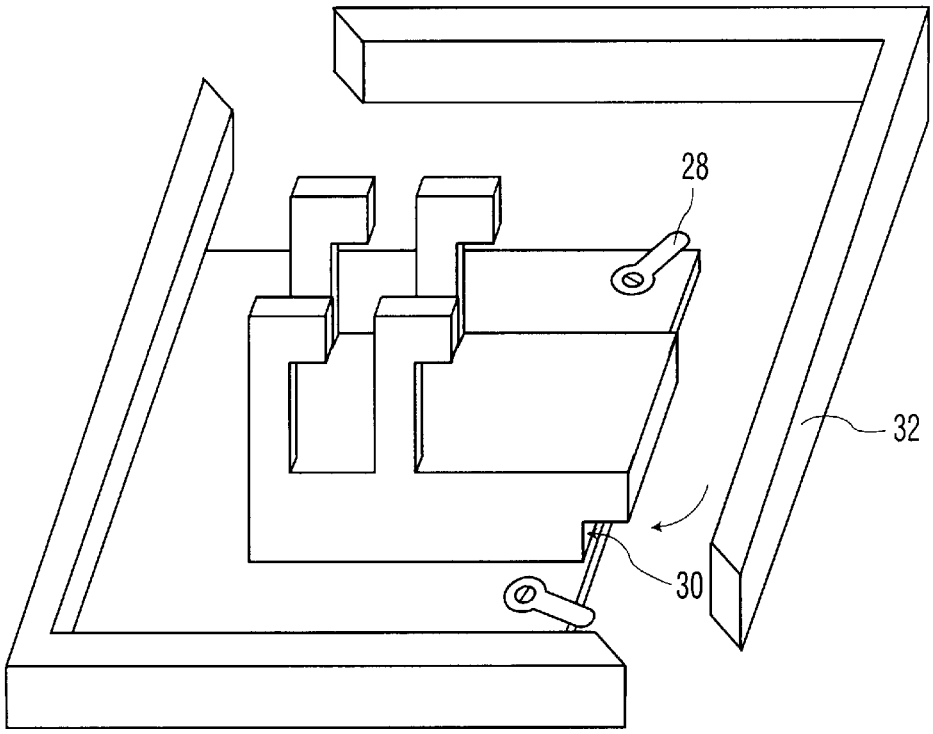
FIGS. 5A and 5B show the device in conjunction with a disassembled picture frame, with FIG. 5A showing the device being inserted for displaying the frame horizontally, and FIG. 5B showing the device being inserted for displaying the frame vertically.
Figure 5B:
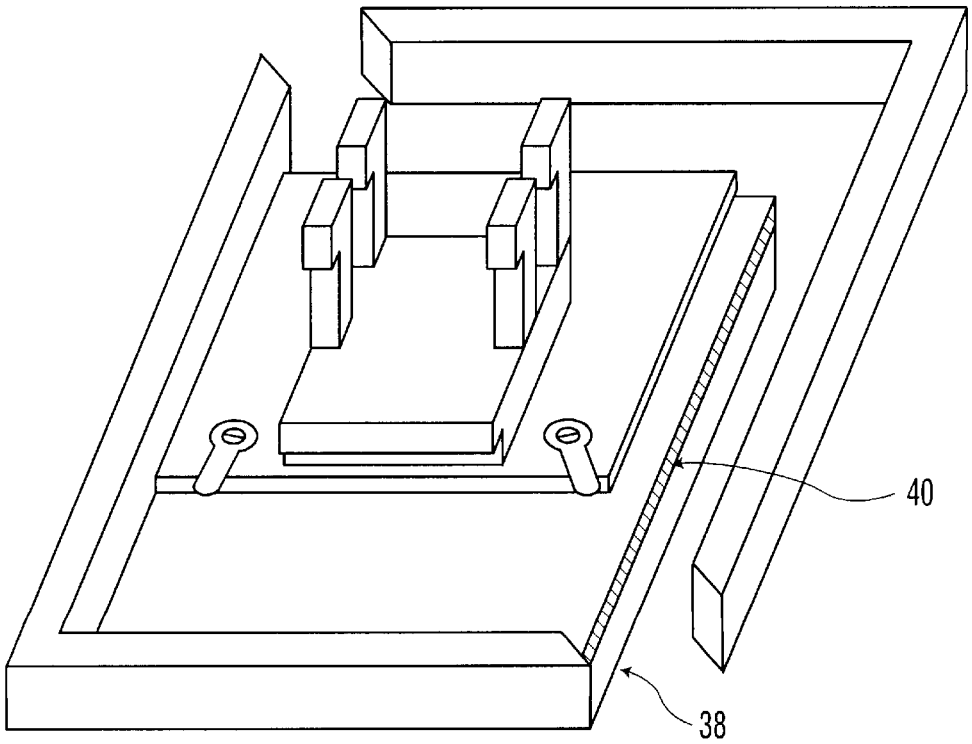

FIGS. 5A and 5B illustrate how the device 10 can be used to hang a picture in a frame 32 either horizontally or vertically. In FIG. 5A, the device and frame are positioned for hanging the picture horizontally, whereas in FIG. 5A, the device and frame are positioned for hanging the picture vertically. As can be seen in FIG. 5A, the crevice 30 defined by the lip 29 serves to accommodate the edge of the frame when the device is positioned for hanging the frame horizontally. Further, once the pieces of the frame are positioned on the device and secured together, the latches 28 can be rotated and inserted into a channel of the frame (shown in FIG. 4), for biasing the device against the glass cover 38, cardboard insert 40, and frame.

It will be understood that the embodiments described herein are merely exemplary and that a person skilled in the art may make variations and modifications without departing from the spirit and scope of the invention. All such variations and modifications are intended to be included within the scope of the appended claims.

I claim:

1. An attachment device for securing a frame to a display apparatus of a type having a support grid, the support grid comprising a first plurality of parallel members and a second plurality of parallel members, wherein the first and second plurality of parallel members intersect at a predetermined angle and have a uniform thickness to define a plurality of compartments, the attachment device comprising:

a planar base having top and bottom oppositely-disposed surfaces;

a support panel secured to one surface of the planar base, the support panel being adapted to be inserted within a frame; and, four generally L-shaped legs disposed on the other surface of the planar base, each of said legs having a connecting member and a hook member extending from said connecting member, wherein each connecting member is disposed generally perpendicular to the base and extend away from the base in the direction opposite the support panel, and wherein each hook member is disposed generally parallel to the base, and wherein the legs are adapted to be inserted within the compartments of the support grid for hanging the frame, and wherein the planar base has a side edge with a lip defining a crevice between the support panel and the top surface of the planar base for accommodating the edge of the frame.

2. The device of claim 1, further comprising a plurality of latches pivotally attached to the support panel for securing the support panel to a picture frame.

3. A device for displaying a planar object with a display apparatus of a type having a support grid, the support grid comprising a first plurality of parallel members and a second plurality of parallel members, wherein the first and second plurality of parallel members intersect at a predetermined angle and have a uniform thickness to define a plurality of compartments, the device comprising: an attachment device and a frame capable of displaying a planar object, wherein the attachment device comprises:

a planar base having top and bottom oppositely-disposed surfaces;

a support panel secured to one surface of the planar base, the support panel being adapted to be inserted within the frame; and, a plurality of elongated legs disposed on the other surface of the planar base, wherein the legs are disposed generally perpendicular to the base and extend away from the base in the direction opposite the support panel and wherein the legs are adapted to be inserted within the compartments of the support grid for hanging the frame;

wherein the planar base has a side edge having a lip that defines a crevice disposed between the support panel and said top surface of the planar base for accommodating an edge of the frame; and, wherein the frame has a plurality of channels for accommodating a side edge of the support panel of the attachment device so that the frame can be secured around the attachment device and the attachment device can secure the frame to the support grid.

4. The display of claim 3, wherein the plurality of legs are L-shaped having two members, a connecting member and a hook member, wherein the connecting member is disposed substantially parallel to the base.

5. The display device of claim 4, wherein said plurality of legs comprises four L-shaped legs.

6. The display device of claim 4, further comprising a plurality of latches pivotally attached to the support panel, wherein the latches can be slid within a channel of the picture frame for securing the support panel to the picture frame.

7. A display apparatus comprising:

a support grid having a first plurality of parallel members and a second plurality of parallel members, wherein the first and second plurality of parallel members intersect at a predetermined angle and have a uniform thickness to define a plurality of compartments;

a frame capable of displaying a planar object; and an attachment device comprising:

a planar base having top and bottom oppositely-disposed surfaces, said planar base including a side edge with a lip;

a support panel secured to one surface of the planar base wherein said lip defines a crevice between the support panel and the top surface of the planar base, the support panel being adapted to be inserted within the frame; and four generally L-shaped legs disposed on the other surface of the planar base, each of said legs having a connecting member and a hook member extending from said connecting member, wherein each connecting member is disposed generally perpendicular to the base and extend away from the base in the direction opposite the support panel, wherein each hook member is disposed generally parallel to the base, wherein the legs are adapted to be inserted within the compartments of the support grid for hanging a frame, and wherein the frame has a plurality of channels for accommodating a side edge of the support panel of the attachment device so that the attachment device can secure the frame to the support grid.

8. The display apparatus of claim 7, further comprising a plurality of latches pivotally attached to the support panel, wherein the latches can be slid within a channel of the picture frame for securing the support panel to the picture frame.

9. An attachment device for securing a frame to a display apparatus of a type having a support grid, the support grid comprising a first plurality of parallel members and a second plurality of parallel members, wherein the first and second plurality of parallel members intersect at a predetermined angle and have a uniform thickness to define a plurality of compartments, the attachment device comprising:

a planar base having top and bottom oppositely-disposed surfaces;

a support panel secured to one surface of the planar base, the support panel being adapted to be inserted within the frame; and, a plurality of elongated legs disposed on the other surface of the planar base, wherein the legs are disposed generally perpendicular to the base and extend away from the base in the direction opposite the support panel and wherein the legs are adapted to be inserted within the compartments of the support grid for hanging the frame, and wherein the planar base has a side edge with a lip defining a crevice between the support panel and the top surface of the planar base for accommodating the edge of the frame.

10. A display apparatus comprising:

a support grid having a first plurality of parallel members and a second plurality of parallel members, wherein the first and second plurality of parallel members intersect at a predetermined angle and have a uniform thickness to define a plurality of compartments;

a frame capable of displaying a planar object; and an attachment device comprising:

a planar base having top and bottom oppositely-disposed surfaces;

a support panel secured to one surface of the planar base, the support panel being adapted to be inserted within the frame, wherein the planar base has a side edge with a lip defining a crevice between the support panel and the top surface of the base for accommodating a border edge of the frame; and a plurality of elongated legs disposed on the other surface of the planar base, wherein the legs are disposed generally perpendicular to the base and extend away from the base in the direction opposite the support panel and wherein the legs are adapted to be inserted within the compartments of the support grid for hanging the frame; and wherein the frame has a plurality of channels for accommodating a side edge of the support panel of the attachment device so that the attachment device can secure the frame to the support grid.

* * * * *